US008469172B2

(12) United States Patent
Shishikura

(10) Patent No.: US 8,469,172 B2
(45) Date of Patent: Jun. 25, 2013

(54) PROCESSING DATA TRANSFER METHOD IN SHEET PROCESSING

(75) Inventor: Masahiro Shishikura, Tokyo (JP)

(73) Assignee: Kabushiki Kaisha Tosiba, Tokyo (JP)

( * ) Notice: Subject to any disclaimer, the term of this patent is extended or adjusted under 35 U.S.C. 154(b) by 309 days.

(21) Appl. No.: 13/033,774

(22) Filed: Feb. 24, 2011

(65) Prior Publication Data

US 2011/0154463 A1 Jun. 23, 2011

Related U.S. Application Data

(62) Division of application No. 11/219,865, filed on Sep. 7, 2005, now Pat. No. 7,921,978.

(30) Foreign Application Priority Data

Jan. 19, 2005 (JP) ..... 2005-011749

(51) Int. Cl.
*G07F 7/00* (2006.01)

(52) U.S. Cl.
USPC ..... 194/208; 194/206; 194/209

(58) Field of Classification Search
USPC ..... 194/206–209; 209/534
See application file for complete search history.

(56) References Cited

U.S. PATENT DOCUMENTS

| | | | |
|---|---|---|---|
| 4,747,050 | A | 5/1988 | Brachtl et al. |
| 5,604,801 | A | 2/1997 | Dolan et al. |
| 5,737,418 | A | 4/1998 | Saffari et al. |
| 6,119,945 | A | 9/2000 | Muller et al. |
| 6,311,165 | B1 | 10/2001 | Coutts et al. |
| 6,363,164 | B1 | 3/2002 | Jones et al. |
| 6,577,733 | B1 | 6/2003 | Charrin |
| 6,993,582 | B2 | 1/2006 | Holden et al. |
| 7,043,641 | B1 | 5/2006 | Martinek et al. |
| 7,104,383 | B1 | 9/2006 | Saltsov et al. |
| 7,203,841 | B2 | 4/2007 | Jackson et al. |
| 7,206,408 | B1 | 4/2007 | Naccache |
| 2002/0154808 | A1 | 10/2002 | Jones et al. |
| 2003/0106770 | A1 | 6/2003 | Lundblad |
| 2003/0163699 | A1 | 8/2003 | Pailles et al. |
| 2003/0178281 | A1 | 9/2003 | Goto et al. |
| 2004/0059676 | A1 | 3/2004 | Rozendaal et al. |
| 2004/0148502 | A1 | 7/2004 | Gollner et al. |

FOREIGN PATENT DOCUMENTS

| | | | |
|---|---|---|---|
| DE | 44 42 357 | A1 | 6/1996 |
| EP | 0 112 944 | A1 | 7/1984 |
| EP | 0 823 694 | A1 | 2/1998 |
| EP | 1 286 314 | A2 | 2/2003 |
| EP | 1286314 | | 2/2003 |
| JP | 2002-260140 | | 9/2002 |
| JP | 2003-058928 | | 2/2003 |
| WO | WO 99/38129 | | 7/1999 |

*Primary Examiner* — Jeffrey Shapiro

(74) *Attorney, Agent, or Firm* — Pillsbury Winthrop Shaw Pittman, LLP

(57) ABSTRACT

This invention is to prevent a MAC of a correct answer from being calculated by use of an IC card even if count data in the database of a PC is falsified since the MAC calculated by the IC card is made invisible from the exterior of the IC card. Thus, falsification of data by enciphering the number (total sum) of cut sheets in a sheet checking equipment.

5 Claims, 4 Drawing Sheets

PROCESSING DATA TRANSFER METHOD IN SHEET PROCESSING

CROSS-REFERENCE TO RELATED APPLICATIONS

This application is a divisional of U.S. application Ser. No. 11/219,865, filed Sep. 7, 2005 now U.S. Pat. No. 7,921,978, and to which priority is claimed under 35 U.S.C. §121. This application is based upon and claims the benefit of priority from prior Japanese Patent Application No. 2005-011749, filed Jan. 19, 2005, the entire contents of both applications are incorporated herein by reference in their entireties.

BACKGROUND OF THE INVENTION

1. Field of the Invention

This invention relates to a processing data transfer method in a sheet processing apparatus which separates securities such as banknotes into banknotes to be used again and banknotes which are not used again by checking the banknotes while the banknotes are being fed one by one, sealing every preset number of banknotes to be used again and cutting the banknotes which are not used again.

2. Description of the Related Art

Conventionally, a sheet processing apparatus is configured by an equipment main body which processes paper sheet or the like and an information processing equipment which manages the equipment main body. The state and the number of paper sheets or the like which are processed by the equipment main body are checked and data of the processing result checked is managed by the information processing equipment (refer to Jpn. Pat. Appln. KOKAI Publication No. 2002-260140).

In the above apparatus, in the case of data indicating the number (total sum) of cut sheets, data is enciphered in order to prevent data falsification.

For example, data (count information) of the number (total sum) of cut sheets by the equipment main body and MAC (Message Authentication Code) are transmitted to the information processing equipment. The information processing equipment stores the received count information and MAC into a database and transmits the count information to an IC card. Then, the IC card calculates the MAC based on the received count information by use of an enciphering key and returns the result of calculation as a response to the information processing equipment. Thus, the information processing equipment compares the MAC from the IC card with the MAC from the equipment main body to check whether or not they coincide with each other.

If the IC card and the password of the IC card are stolen, the following two problems will occur.

1) It becomes possible to attain a correct answer with respect to the MAC by supplying the count information to the IC card after falsifying the count information in the database. Then, if the MAC calculated by the equipment main body on the database is falsified by use of the MAC of the correct answer and subjected to the checking process again by use of the IC card, there occurs a problem that the result of the checking process becomes correct.

2) There occurs a problem that an enciphering key which is used to calculate the MAC can be estimated by sequentially changing data items supplied to the IC card.

BRIEF SUMMARY OF THE INVENTION

An object of this invention is to prevent falsification of count information such as the number of sheets cut by the equipment main body without fail in a sheet processing apparatus which is configured by an equipment main body which processes paper sheets or the like and an information processing equipment which manages the equipment main body.

A processing data transfer method according to a first aspect of the present invention in a sheet processing apparatus configured by an equipment main body which processes sheets and an information processing equipment which manages the equipment main body comprises transmitting count information attained by the equipment main body and a MAC formed by use of the count information and enciphering key to the information processing equipment, registering the count information and MAC received by the information processing equipment into a database and transmitting the same to an IC card, calculating a MAC by use of the count information received by the IC card and an enciphering key which is the same as the above enciphering key, comparing the thus calculated MAC with the MAC from the equipment main body and returning a response indicating whether the compared MACs coincide with each other to the information processing equipment, and permitting the information processing equipment to output the comparison result of the MAC from the IC card as a checking result.

A processing data transfer method according to a second aspect of the present invention in a sheet processing apparatus configured by an equipment main body which processes sheets supplied thereto and classifies the sheets based on the checking result and an information processing equipment which manages the equipment main body by registering processing data of the checking result containing at least the number of classified sheets from the equipment main body comprises transmitting count information attained by the equipment main body and a MAC formed by use of the count information and enciphering key to the information processing equipment, registering the count information and MAC received by the information processing equipment into a database and transmitting the same to an IC card, calculating a MAC by use of the count information received by the IC card and an enciphering key which is the same as the above enciphering key, comparing the thus calculated MAC with the MAC from the equipment main body and returning a response indicating whether the compared MACs coincide with each other to the information processing equipment, and permitting the information processing equipment to output the comparison result of the MAC from the IC card as a checking result.

DETAILED DESCRIPTION OF THE INVENTION

There will now be described an embodiment of this invention with reference to the accompanying drawings.

Figure 1:
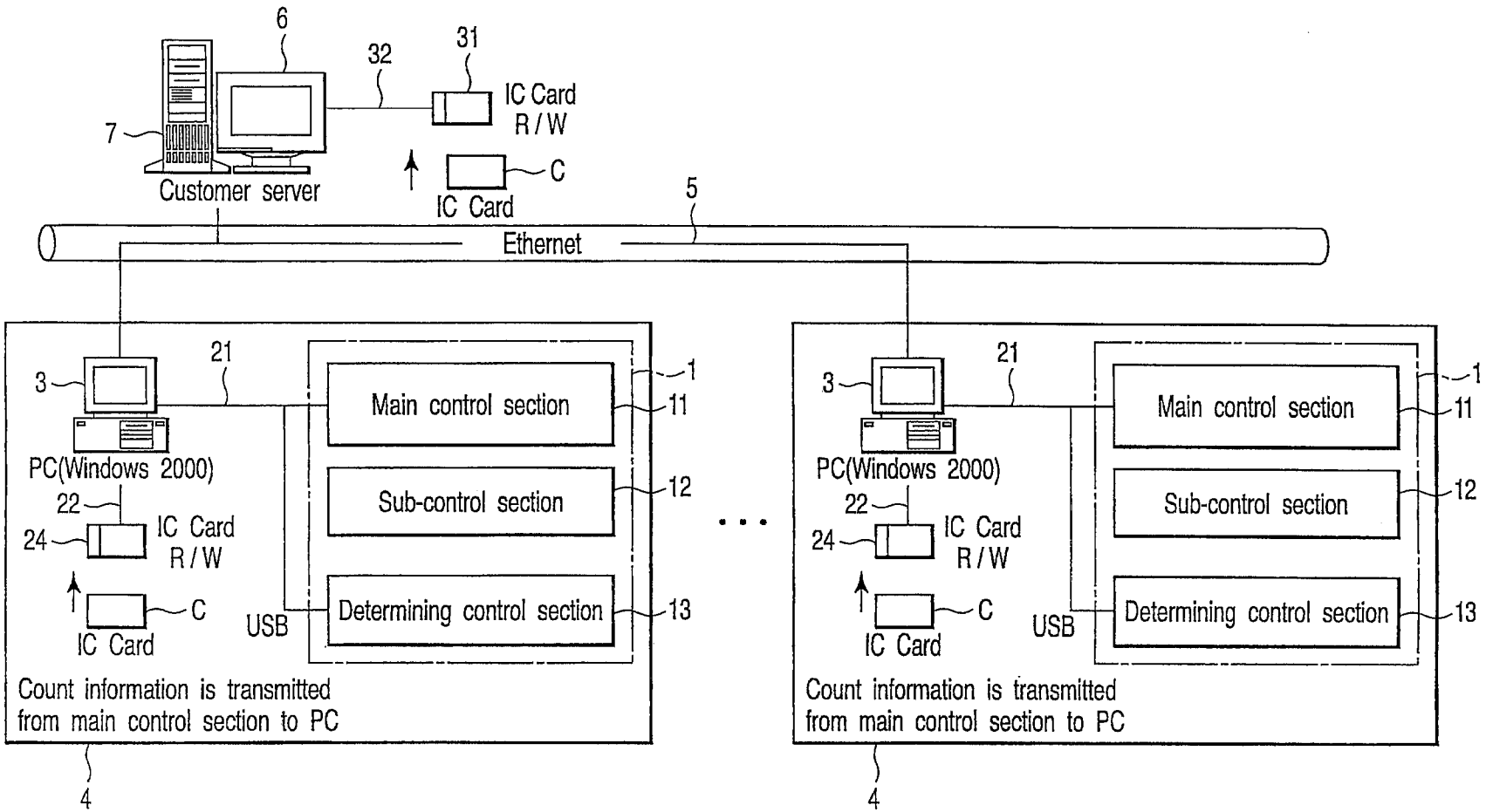
FIG. 1 is a block diagram showing the schematic configuration of a paper-like sheet processing system, for illustrating one embodiment of this invention.

FIG. 1 is a system configuration diagram of a checking device used as a paper-like sheet processing system for overseas financial institutions.

That is, the paper-like sheet processing system has a plurality of sheet processing apparatuses 4 which are each configured by an equipment main body 1 which checks paper sheets (banknotes) supplied thereto and classifies the paper sheets based on the checking result and an information processing equipment (PC) 3 which manages the equipment main body by registering processing data of the processing result containing at least the number of classified sheets from the equipment main body 1 into a database 2. The plurality of sheet processing apparatuses 4 are connected via Ethernet 5 and a server 6 is connected to Ethernet 5.

The equipment main body 1 performs the following process. That is, it determines whether securities as paper sheets are true or false while they are being fed one by one. The true note or security is further subjected to an undamaged/damaged state determining process. Thus, the true note is separated into a practically undamaged note or excessively damaged note. Every preset number of practically undamaged notes are sealed and the excessively damaged notes are cut into pieces so as not to be used again. Thus, processing data of the processing result containing at least the number of sheets of securities which are subjected to the cutting process is output.

The equipment main body 1 has a main control section (control main unit) 11 which controls the whole portion thereof. The main control section 11 realizes the function which permits the present apparatus to be operated so as to serve the preset purpose by collectively processing data items from a sub-control section 12 and determining control section 13 and finally transferring data with respect to the information processing equipment 3.

The information processing equipment 3 specifies the operation mode of the equipment main body 1 and operates the equipment main body. Further, it adequately monitors the operation state of each equipment main body 1, totalizes processing data output from the equipment main body 1 by use of the database 2 and prints the totalization result for each operation. The information processing equipment 3 is connected to the equipment main body 1 and IC card reader/writer 23 via USB (Universal Serial Bus) cables 21, 22.

The server 6 is connected to the information processing equipment 3 of the sheet processing apparatus 4 via Ethernet 5 and has a function of totalizing processing data by use of a database 7. Further, the server 6 performs the control operation for an IC card reader/writer 31 which will be described later. The server 6 is connected to the IC card reader/writer 31 via a USB (Universal Serial Bus) cable 32.

Figure 2:
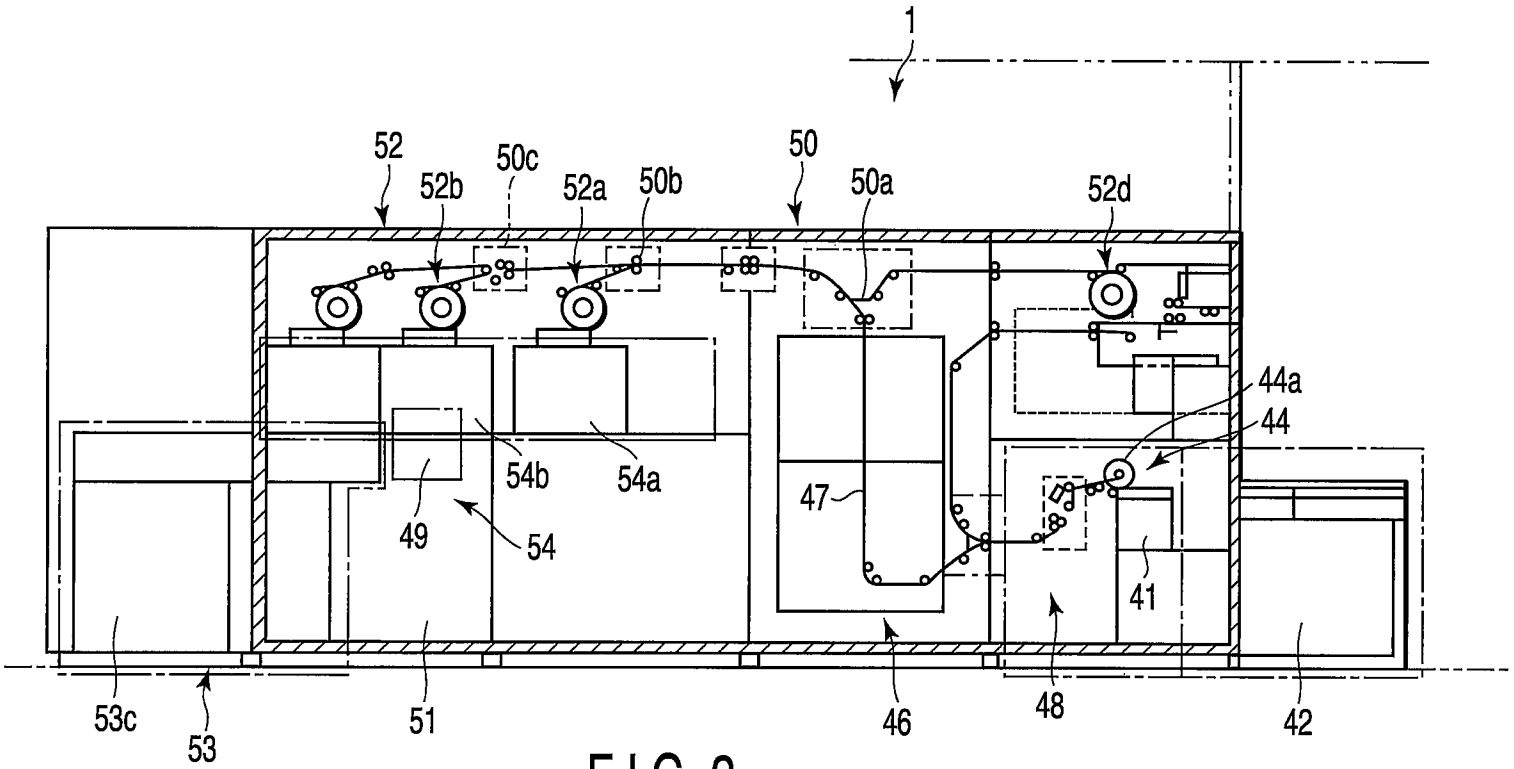
FIG. 2 is an internal configuration view showing the schematic configuration of an equipment main body.

The schematic configuration of the equipment main body 1 is explained with reference to FIG. 2.

That is, the equipment main body 1 configured to process a preset number of paper sheets, for example, 1000 paper sheets as one unit. On the right end portion of the equipment main body 1, a sheet inserting unit 42 which automatically and sequentially inserts paper sheets in a stacked state for every 1000 sheets is provided.

The equipment main body 1 includes a fetching section 44 which sequentially fetches inserted paper sheets or the like one by one, a feeding device 46 which feeds the fetched sheet along a preset feeding path 47, a determining section 48 which detects information such as a pattern, dimension and feeding pitch from the sheet which is now being fed, a separating section 20 which selectively sets the feeding direction of the sheet according to the detection result, a storing section 22 which stores the thus separated sheets, a sealing section 24 which seals the stored paper sheets or the like for every preset number of sheets, and an invalidating section (cutting section) 23 which cuts and receives the paper sheets to be discarded.

A supply device 41 is provided near the fetching section 44. The supply device 41 receives the paper sheet P inserted from the inserting unit 42 and supplies the paper sheet to the fetching section 44. An attraction rotation roller 44*a* of the fetching section 44 fetches the paper sheets P one by one at preset pitches and transfers the paper sheet to the feeding device 46. The feeding device 46 is configured by a plurality of conveyor belts, driving pulleys, driving motors and the like arranged along the preset feeding path 47.

The determining section 48 includes a stacked-state detecting unit which detects a stacked state of the paper sheets P which are being fed, a reading unit which reads a pattern attached to the paper sheet P and a counter unit which counts the number of paper sheets P. The above units are arranged along the feeding path 47.

The paper sheets P which are subjected to the counting process, pattern reading process and length detecting process in the determining section 48 are classified into a plurality of types, for example, four types of paper sheets according to the detection result. Thus, the paper sheets are classified and stored for each type. A separating section 50 has three distribution gates 50*a*, 50*b*, 50*c* provided along the feeding path 47. The feeding path for the paper sheet is switched by selectively switching each gate position and the paper sheet is guided to a corresponding storage portion of a storing section 52 according to the type of the paper sheet.

The storing section 52 has two storing units 52*a*, 52*b* corresponding to the types of the paper sheets. A sealing section 54 includes sealing units 54*a*, 54*b* (paper sheet sealing units) (which are hereinafter simply referred to as sealing units) respectively arranged below the storing units 52*a*, 52*b*, a bundle sealing section 49 and a bundle packaging section 51. The invalidating section 53 includes a shredder and discarding box 53*c* and configures a number-of-sheets processing device.

Figure 3:
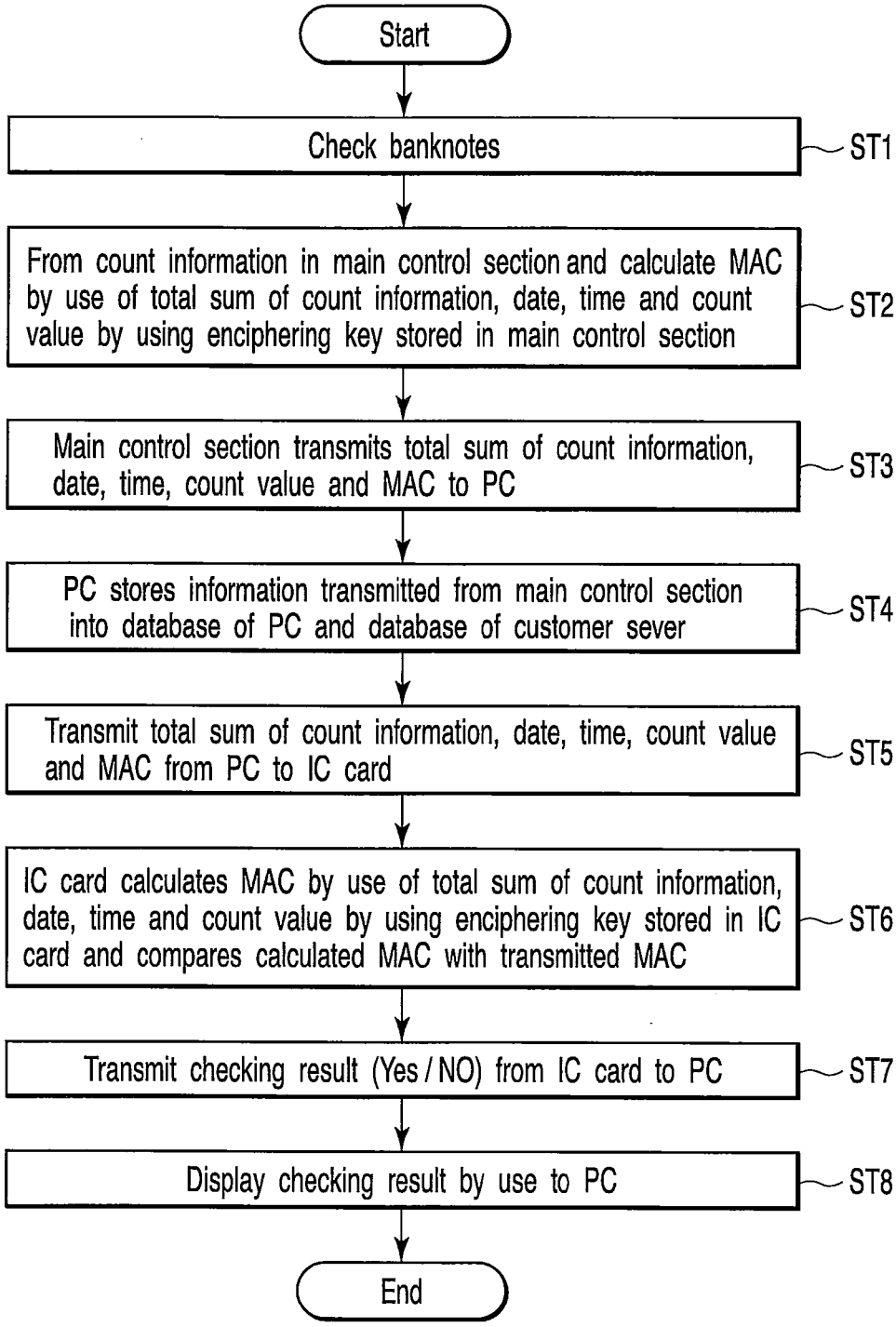
FIG. 3 is a flowchart for illustrating the count information checking process.
Figure 4:
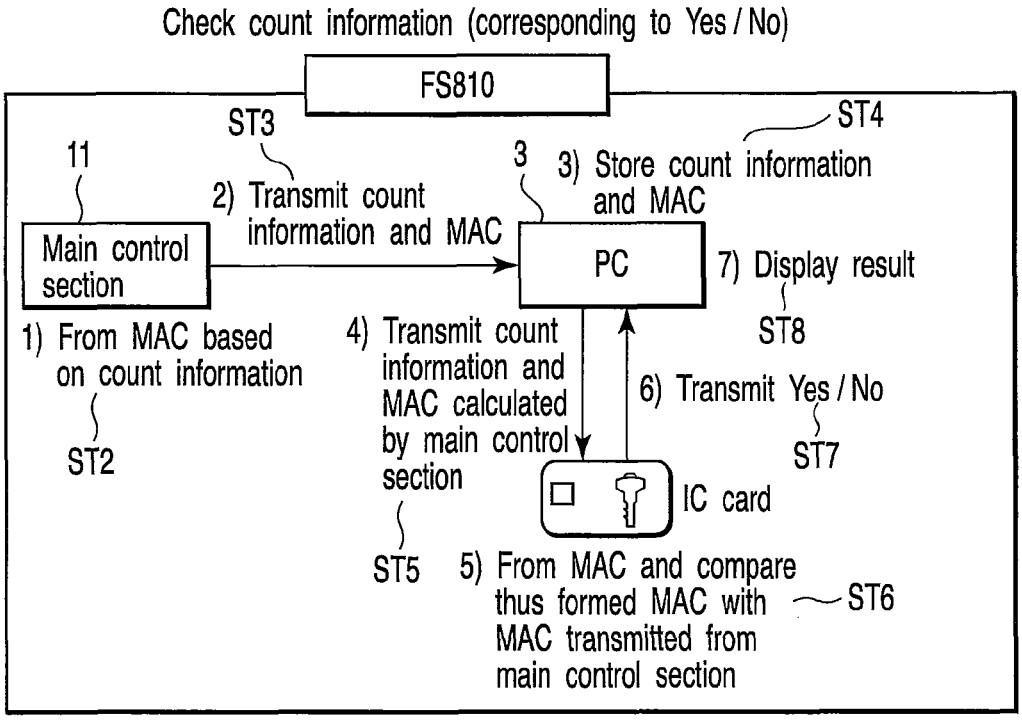
FIG. 4 is a diagram for illustrating the count information checking process.

With the above configuration, the count information checking process is explained with reference to the flowchart of FIG. 3 and a flow of information shown in FIG. 4.

First, a paper sheet is checked by use of the equipment main body 1 (ST1). That is, the equipment main body 1 determines whether the security is true or false while feeding the securities as paper sheets one by one. Further, it determines the true note or security as a practically undamaged note or excessively damaged note by subjecting the true note to an undamaged/damaged state determining process. Then, every preset number of practically undamaged notes are sealed and the excessively damaged notes are cut into pieces so as not to be used again. Thus, processing data of the processing result containing at least the number of sheets of securities which are subjected to the cutting process is output.

The main control section 11 forms count information and forms a MAC by use of the total sum of count information, date, time, count value and enciphering key stored in an internal memory (not shown) (ST2). The main control section 11 transmits the total sum of count information, date, time, count value and MAC to the information processing equipment 3 (ST3). The information processing equipment 3 stores count information transmitted from the main control section 11 into the database 2 of the information processing equipment 3 and stores the count information into the database 7 of the server 6 (ST4).

Further, when the count information is checked in the information processing equipment 3 after the end of the operation, the information processing equipment 3 transmits the total sum of count information, date, time, count value and MAC to the IC card by use of the IC card reader/writer 23 (ST5).

Thus, the IC card calculates a MAC by use of the total sum of count information, date, time, count value and the like by using an enciphering key (which is the same as the enciphering key of the main control section 11) stored in the internal memory. Then, it compares the MAC transmitted from the information processing equipment 3 with the calculated MAC by use of an internal control element and outputs the comparison result as a checking result (ST6). The checking result (Yes/No) from the IC card is transmitted to the information processing equipment 3 via the IC card reader/writer 23 (ST7). As a result, the information processing equipment 3 displays the checking result (ST8).

Further, like the information processing equipment 3, the count information can be checked in the server 6 by use of an IC card C.

As described above, the security of cutting data in the paper sheet checking equipment can be enhanced by calculating a MAC based on the cutting data. In the paper sheet checking equipment, falsification of count information is prevented by making the MAC calculated in the IC card invisible from the exterior.

The following effects can be expected in the paper sheet checking equipment. Since the MAC calculated by the IC card is made invisible from the exterior of the IC card, a MAC of a correct answer cannot be calculated by use of the IC card even if count data in the database of the PC is falsified.

Therefore, the checking result always becomes "No" if data is falsified and the checking process is performed by use of the IC card. Further, it becomes possible to prevent estimation of the enciphering key used to calculate a MAC by sequentially changing data to be transmitted to the IC card. In addition, even when the IC card and the password thereof are stolen, falsification of the count information can be prevented.

As a result, falsification of data by enciphering the number (total sum) of cut sheets in the paper sheet checking equipment can be prevented.

What is claimed is:

1. A processing data transfer method in a sheet processing apparatus configured by an equipment main body which processes sheets and an information processing equipment which manages the equipment main body, comprising:

transmitting count information attained by the equipment main body and a MAC formed by use of the count information and enciphering key to the information processing equipment, registering the count information and MAC received by the information processing equipment into a database and transmitting the same to an IC card, calculating a MAC by use of the count information received by the IC card and an enciphering key which is the same as the above enciphering key, comparing the thus calculated MAC with the MAC from the equipment main body and returning a response indicating whether the compared MACs coincide with each other to the information processing equipment, and permitting the information processing equipment to output the comparison result of the MAC from the IC card as a checking result.

2. The method according to claim 1, wherein the count information is the number of sheets which are determined not to be used again, subjected to a cutting process and set into an unusable state.

3. The method according to claim 1, wherein the count information contains at least one of the total sum of count information, date, time and count value.

4. A processing data transfer method in a sheet processing apparatus configured by an equipment main body which checks sheets supplied thereto and classifies the sheets based on the checking result and an information processing equipment which manages the equipment main body by registering processing data of the checking result containing at least the number of classified sheets from the equipment main body, comprising:

transmitting count information attained by the equipment main body and a MAC formed by use of the count information and enciphering key to the information processing equipment, registering the count information and MAC received by the information processing equipment into a database and transmitting the same to an IC card, calculating a MAC by use of the count information received by the IC card and an enciphering key which is the same as the above enciphering key, comparing the thus calculated MAC with the MAC from the equipment main body and returning a response indicating whether the compared MACs coincide with each other to the information processing equipment, and permitting the information processing equipment to output the comparison result of the MAC from the IC card as a checking result.

5. The method according to claim 4, wherein the processing result contains the number of sheets which are subjected to a cutting process when the sheets which are determined not to be used again by the sheet checking process are subjected to the cutting process and set into an unusable state.

* * * * *

UNITED STATES PATENT AND TRADEMARK OFFICE

CERTIFICATE OF CORRECTION

PATENT NO. : 8,469,172 B2
APPLICATION NO. : 13/033774
DATED : June 25, 2013
INVENTOR(S) : Shishikura It is certified that error appears in the above-identified patent and that said Letters Patent is hereby corrected as shown below:

On title page, item (54) Title should read

--PROCESSING DATA TRANSFER METHOD IN SHEET PROCESSING APPARATUS--.

On title page, item (73) Assignee should read

--KABUSHIKI KAISHA TOSHIBA--.

Signed and Sealed this
Third Day of May, 2016

Michelle K. Lee

Michelle K. Lee
*Director of the United States Patent and Trademark Office*